United States Patent [19]

Muzzell

[11] 4,407,492

[45] Oct. 4, 1983

[54] INTEGRATED SPRING MAT ASSEMBLY FOR SEATING

[75] Inventor: Stephen E. Muzzell, Ferndale, Mich.

[73] Assignee: Gulf & Western Manufacturing Company, Southfield, Mich.

[21] Appl. No.: 311,914

[22] Filed: Oct. 16, 1981

[51] Int. Cl.[3] ..... F16F 3/02

[52] U.S. Cl. ..... 267/103; 297/452

[58] Field of Search ..... 267/102, 103, 106, 110, 267/142; 297/452

[56] References Cited

U.S. PATENT DOCUMENTS

| | | | |
|---|---|---|---|
| 2,848,038 | 8/1958 | Bank et al. | 267/102 |
| 4,050,738 | 9/1977 | Griffiths | 267/103 X |
| 4,337,931 | 7/1982 | Mundell et al. | 267/102 |

*Primary Examiner*—Duane A. Reger

*Attorney, Agent, or Firm*—Body, Vickers & Daniels

[57] ABSTRACT

A spring mat assembly for a seat or seat back frame has a pair of relatively widely spaced longitudinal bolster wires across which a plurality of relatively closely spaced transverse stringer wires are connected as by wrapping therearound. The stringer wires extend outwardly beyond each of the bolster wires to form wing edges including a fixed wing at each end of the assembly for attachment to the seat frame, and a free wing on at least one end of the assembly to form with the adjacent fixed wing a split-wing edge on the assembly. The outwardly projecting portions of the stringer wires forming the free wing portion or portions preferably extend at an obtuse angle to their intermediate portions extending between the bolster wires, and they are interconnected at their outermost ends by a longitudinal wire as by being tightly hooked therearound. The stringer wires forming each of the fixed wing portions are either formed with open hook outer ends for attachment to the seat frame or are interconnected at their outer ends by separate additional longitudinal border wires as by being tightly hooked therearound.

41 Claims, 24 Drawing Figures

FIG. 16
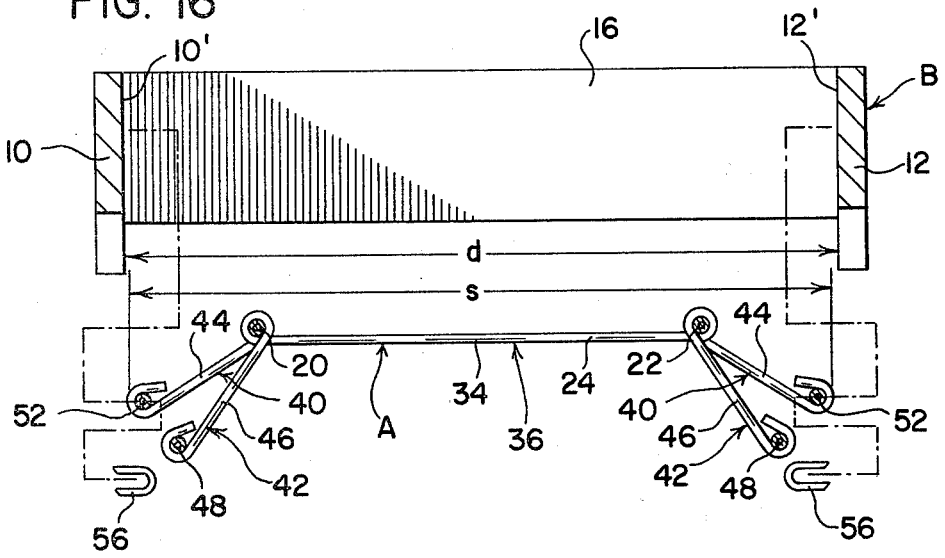
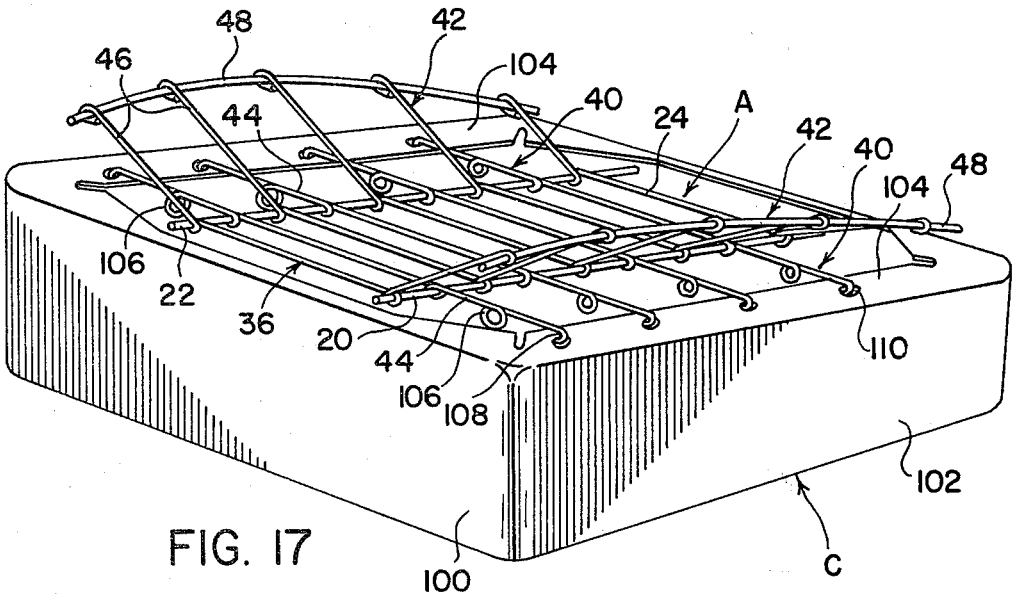
FIG. 17

INTEGRATED SPRING MAT ASSEMBLY FOR SEATING

BACKGROUND OF THE INVENTION

This invention relates, in general, to a spring mat assembly for upholstered seating, as for a seat base or back, and to a method of fabrication thereof, and has particular reference to that class of seating commonly known as "soft edge" seating.

Certain types of seating constructions in popular use at present, such as for so-called "bucket" seats in automobiles, for instance, as well as for other types of seating, desirably incorporate flexible or soft edge bolster wings which are upwardly or forwardly and outwardly inclined lateral edge portions of the seating surfaces. These bolster wings serve to keep the body of the seated person laterally centered in the seat, thus, contributing to better posture and comfort of the user.

Such seating constructions conventionally incorporate some type of spring decking or a spring mat assembly over which padding and upholstery layers are applied, or in some instances the spring decking is molded or encapsulated directly within a padding material such as natural or synthetic rubber or plastic foam. However, the constructions of the spring decking heretofore employed or proposed for such purpose, to provide the necessary spring yield and to provide the closely spaced supports required for the padding material, and to form and support the bolster wings adequately, generally have been beset with difficulties, such as complicated spring wire structures difficult to fabricate and comprised of many component parts, which often do not lend the spring decking to automatic machine manufacture into an integrated assembly and require instead manual assembly operations such as adds materially to the cost of the spring decking and thus the seat.

DESCRIPTION OF THE PRIOR ART

Spring deck or mat assemblies provided with flexible or free wing edge or bolster supports are disclosed in U.S. Pat. Nos. 3,117,774 Isaacs; 3,356,358 Bond; 3,527,499 Rathbun et al; 3,639,002 and 3,727,980 Tischler; 3,797,886 Griffiths; 3,860,287 Platt; 3,880,467 Tischler; 3,982,737 Platt et al; and 4,171,125 Griffiths. The spring mat assemblies shown in these patents, however, are all characterized by one or more of the various aforementioned difficulties or problems.

SUMMARY OF THE INVENTION

The present invention contemplates a new and improved integrated spring deck or mat assembly for seating which overcomes all of the above referred to problems and others and provides a spring mat assembly which is of simple construction and capable of completely automatic machine manufacture, and having fixed mounting wings at both ends of the assembly and also a bolster-supporting free wing on at least one end of the assembly.

Briefly stated, in accordance with one aspect of the invention, a spring deck or mat for seating is provided comprised of an integrated assembly of a pair of relatively widely spaced bolster wires across which a plurality of relatively closely spaced transverse stringer wires are connected as by tightly wrapping around the bolster wires, the stringer wires projecting outwardly beyond the bolster wires to form fixed wing portions on both ends (or sides) of the spring mat assembly, for attachment to the frame of a seat base or back, as well as an upwardly or forwardly and outwardly inclined free wing portion at one or both ends (or sides) of the assembly, the free wing portion or portions being constituted by selective ones of the stringer wires which are interconnected at their outer ends by a border wire.

In accordance with a further aspect of the invention, the stringer wires forming the fixed wing portions of the spring mat assembly are provided at their outermost ends with fastening means for attaching the assembly to the frame of the seat base or back, the fastening means being constituted either by an additional longitudinal border wire to which the stringer wires of the fixed wing are connected as by being tightly hooked therearound at their outer ends, or by forming the outer ends of these particular stringer wires with open hooks at their outer ends for hooking onto the frame of the seat base or back.

The principal object of the invention is to provide an integrated spring mat assembly for seating applications which is of simple construction and easy to manufacture and incorporates fixed mounting wings at both ends of the assembly as well as a bolster-supporting flexible free wing at one or both ends of the assembly.

Another object of the invention is to provide an integrated spring mat assembly of the above-mentioned type which is relatively inexpensive and is quickly and easily mountable in place on the frame of a seat base or back after the application of upholstery material to the assembly.

Still another object of the invention is to provide an integrated spring mat assembly of the above-mentioned type which is adapted for completely automatic machine manufacture.

A further object of the invention is to provide a spring mat assembly of the above-mentioned type which is very simply preformed as a completed unit and is capable of quick and convenient installation and mounting in a rigid seat frame and which provides all the functions of spring yieldability, fully adequate support of the padding layers, and formation and support of the bolster wings.

A still further object of the invention is to provide a novel method of fabricating a spring mat assembly of the above-mentioned type.

Further objects and advantages of the invention will be apparent from the following detailed description of species thereof and from the accompanying drawings.

BRIEF DESCRIPTION OF THE DRAWINGS

In the drawings:

FIG. 16 is an exploded sectional view of the spring mat assembly and associated seat back frame of FIGS. 14 and 15 illustrating one manner of attaching the assembly to the frame to form the crowned intermediate and fixed wing stringer wire portions thereof;

FIG. 17 is a perspective view of another modified form of spring mat assembly according to the invention shown mounted on a seat base frame;

DESCRIPTION OF THE PREFERRED EMBODIMENTS

Figure 1:
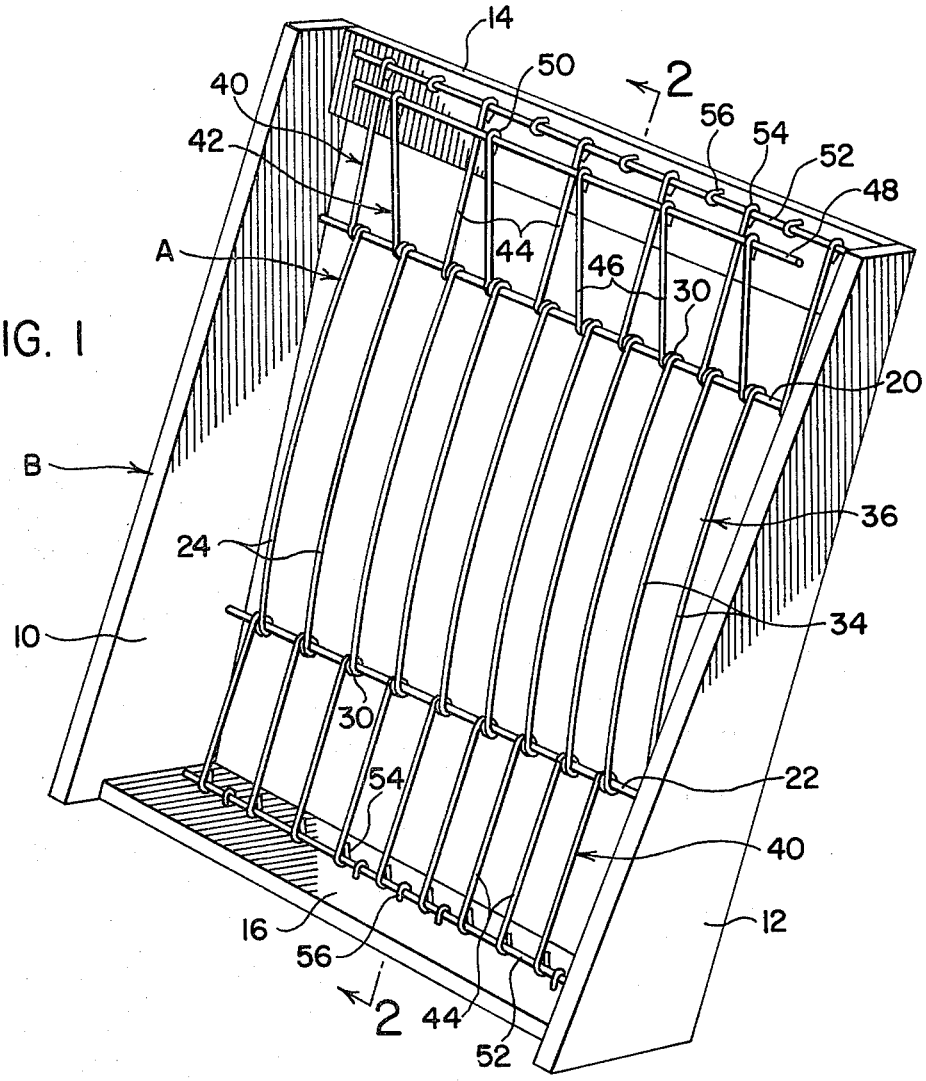
FIG. 1 is a perspective view of a seat back frame having a spring mat assembly comprising the invention mounted therein.
Figure 2:
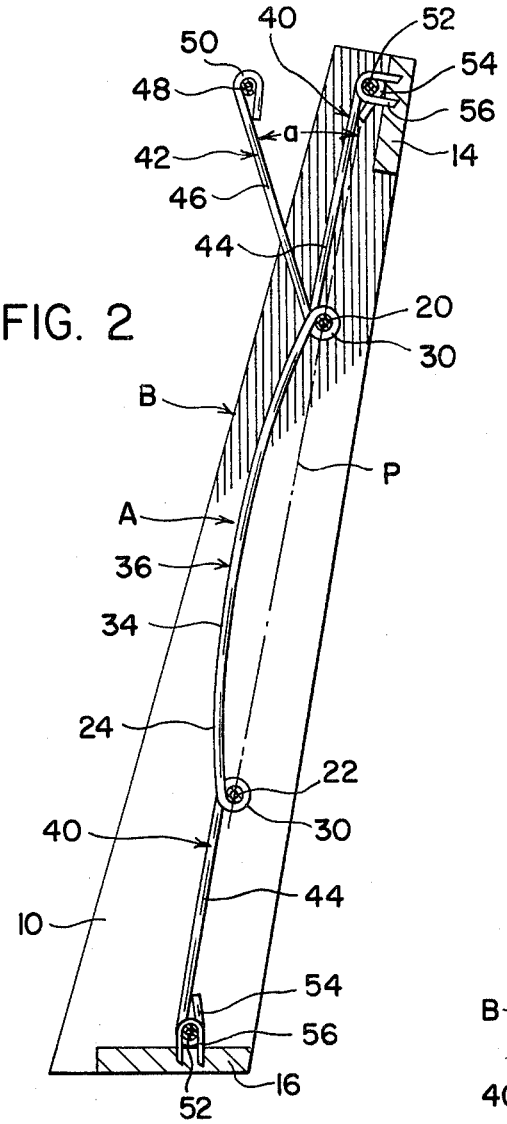
FIG. 2 is a sectional view taken on the line 2—2 of FIG. 1.

Referring to the drawings, wherein the showings are for the purposes of illustrating the preferred embodiments of the invention only and not for the purposes of limiting the same, FIGS. 1 and 2 show a spring deck or mat assembly A comprising the invention mounted in place within or on a rigid seat frame B for either a seat back as shown, or for a seat base, to provide a spring suspension therefor. The frame B which, in the particular case illustrated is formed of wood members, is comprised of a pair of spaced, generally parallel, side rails 10, 12 joined at their opposite ends by a pair of end, or top and bottom rails 14, 16. It will be understood, however, that the frame B could be formed of any other suitable material such as sheet metal, for instance. In accordance with standard practice, padding layers (not shown) of suitable material such as plastic foam may be applied over the spring mat assembly A and overlaid with a suitable upholstery fabric or cover trim material (not shown) which is fastened in place to the frame B, or plastic foam material may be cast or molded about substantially the entire spring mat assembly A and overlaid with the cover trim material, the outer configuration of the foam material simulating the desired outer configuration of the seat base or seat back.

Figure 3:
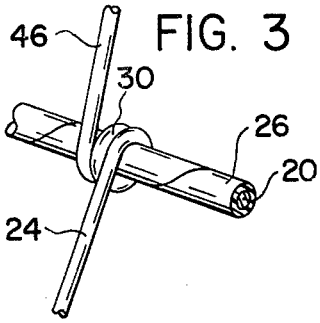
FIG. 3 is a fragmentary perspective view of the spring mat assembly of FIGS. 1 and 2 showing the connection of the stringer wires thereof to the bolster cords or wires.
Figure 11:
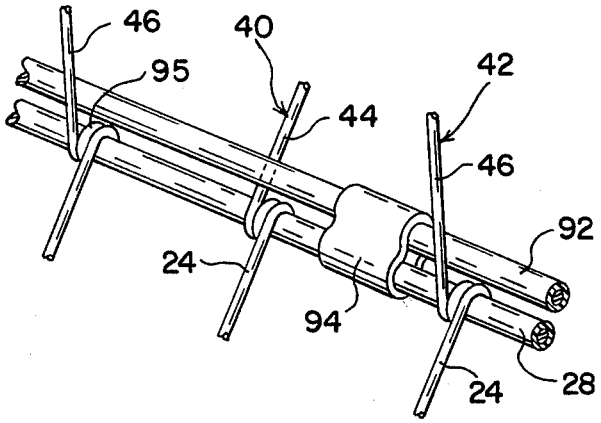
FIG. 11 is a fragmentary perspective view similar to FIG. 3 showing a modified form of the bolster wire support of the assembly which serves to stiffen the wing.

The spring mat assembly A according to the invention comprises a pair of relatively widely spaced longitudinal bolster wires or cords 20 and 22 which are interconnected by a plurality of relatively closely spaced transverse stringer wires 24. The bolster wires 20, 22 may be of the type conventionally employed for this purpose in spring suspensions for seats and generally comprised of steel wire having either a paper wrapping 26 thereover as shown in FIG. 3, or preferably a suitable plastic coating 28 thereon as shown in FIG. 11, in order to thereby eliminate noise which might otherwise result from relative movement between the bolster and stringer wires at their interconnections. In some instances, the bolster wires or strands 20, 22 may be comprised of twisted paper or plastic cords with or without wire cores. The stringer wires 24 are preferably made of spring steel wire such as conventionally employed for this purpose in spring suspensions for seats.

Figure 4:
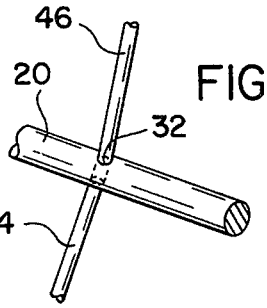
FIGS. 4, 4A and 4B are fragmentary perspective views similar to FIG. 3 but showing modified forms of bolster cords and connections of the stringer wires thereto.
Figure 4A:
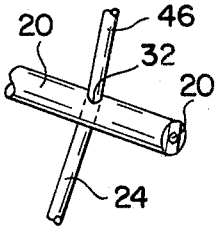
Figure 4B:
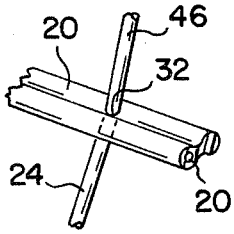

The stringer wires 24 are connected to the bolster wires 20, 22 preferably by tightly wrapping them therearound as with two turns, for example, as shown at 30 in FIG. 3. As an alternative, the stringer wires 24 may simply pierce the bolster wires or cords 20, 22 creating openings 32 therein, as shown in FIGS. 4, 4A and 4B, in which case the bolster wires 20, 22 may be in the form of twisted paper or plastic cords with or without wire cores 33. The portions 34 of the stringer wires 24 extending between the bolster wires 20, 22 and hereinafter referred to as their intermediate wire portions together form a more or less flat, central or main load-carrying portion 36 of the spring mat assembly A. Preferably, as shown in FIGS. 1 and 2, the intermediate stringer wire portions 34 are slightly bowed or crowned forwardly of the seat back, or upwardly in the case of a seat base, to provide a spring support effect.

The stringer wires 24 extend outwardly beyond the respective bolster wires 20, 22 of the spring mat assembly A to form, in accordance with the invention, edge wing portions thereon including a fixed wing portion 40 at each end (or side) of the assembly for attachment to the seat frame B to mount the assembly in place thereon, and a free wing portion 42 on one or both ends (or sides) of the assembly which, together with the adjacent fixed wing portion or portions 40, provides the assembly with either a single split-wing edge construction as shown in FIGS. 1 and 2, or a double split-wing edge construction as shown in FIGS. 10, 12, 13 and 15, for example. The fixed wing portions 40 are formed by outwardly projecting stringer wire portions 44 which, as shown particularly in FIG. 2, extend outwardly from the respective bolster wires 20, 22 in a general plane more or less coincident with the plane P of the two bolster wires. The free wing portion or portions 42, however, are formed by the outwardly projecting portions 46 of selective ones of the stringer wires 24, preferably alternate ones thereof as shown in FIG. 1, which extend outwardly from the respective bolster wire or wires 20, 22 in outwardly spaced or offset relation to the plane of the respective adjacent fixed wing portion or portions 40. Preferably, as in the particular form of the invention shown in FIG. 2, the outwardly projecting stringer wire portions 46 forming the free wing portion or portions 42 extend outwardly from the respective bolster wire or wires 20, 22 at an acute angle a of, for example, around 25° to 40° or so relative to the adjacent fixed wing portion 40 and to plane P of the bolster wires.

The outwardly projecting stringer wire portions 46 forming the free wing portion or portions 42 of the spring mat assembly A are interconnected at their outer ends by a longitudinal steel border wire 48 by being tightly hooked therearound, as indicated at 50. The border wire or wires 48 extend generally parallel to the bolster wire 20 or 22 of the respective free wing portion 42 and they act to join the several stringer wire portions 46 forming each free wing portion 42 into a unified wing structure so as to conjointly yield under loading stresses applied thereto.

The spring mat assembly A is provided with suitable fastening means for attaching the assembly to and mounting it within the seat frame B. The fastening means shown in FIGS. 1 and 2 comprises a pair of additional longitudinal steel border wires 52 each of which interconnects the outer ends of the stringer wire portions 44 forming each respective one of the fixed wing portions 40 of the assembly, as by tightly hooking the wires 44 around the respective border wire 52 as indicated at 54. The border wires 52 are suitably secured to the rails 14 and 16 of the seat frame B, as by means of staples 56, for example.

Figure 5:
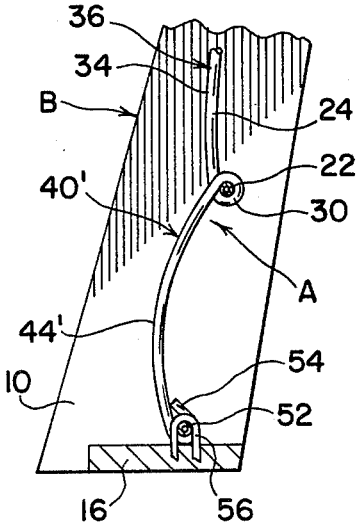
FIG. 5 is a fragmentary sectional view similar to FIG. 2 showing a modified form of the lower fixed wing portion of the spring mat assembly.

FIG. 5 illustrates a modified form of the spring mat assembly A shown in FIGS. 1 and 2 for a seat back frame B wherein the outwardly projecting stringer wire portions 44' forming the fixed wing portion 40' at the lower end of the assembly, opposite the split-wing edge at the top end thereof, are uniformly bowed forwardly or crowned laterally to the same side of the assembly as the intermediate stringer wire portions 34 forming the central load-carrying portion 36 of the assembly are crowned. The crowned lower fixed wing portion 40' provides an effective lumbar support for the seat occupant.

Figure 6:
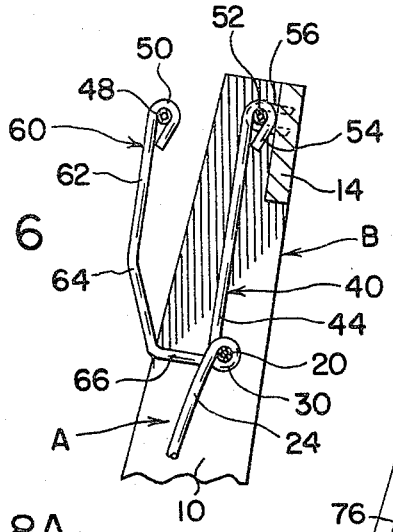
FIG. 6 is a fragmentary sectional view similar to FIG. 2 showing a modified form of the free wing portion at the upper end of the spring mat assembly.

FIG. 6 illustrates a modified free wing construction 60 wherein the outermost end portions 62 of the outwardly projecting stringer wire portions 64 forming the free wing portion or portions 60 of the assembly A are laterally or outwardly offset to extend in generally spaced parallel relation to the stringer wire portions 44 forming the adjacent fixed wing portion 40 instead of at an acute angle thereto as in FIGS. 1 and 2. To this end, the stringer wire portions 64 are formed with lateral leg portions 66 which extend laterally outward from the respective bolster wire 20 or 22 to offset the outermost end portions 62 of the stringer wire portions 64 from the adjacent fixed wing portion 40 of the spring mat assembly A.

Figure 7:
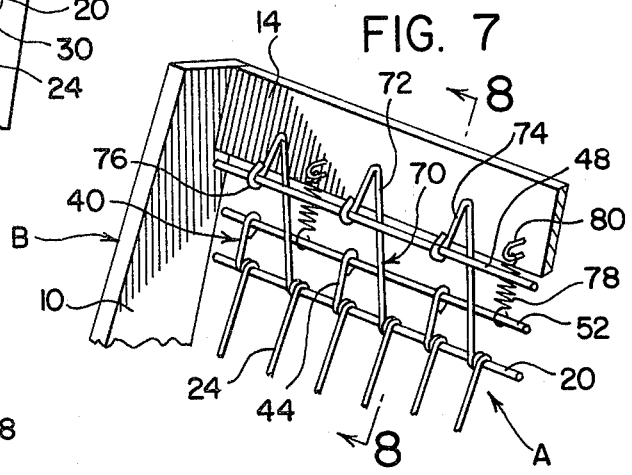
FIGS. 7 and 8 are fragmentary perspective and sectional views, respectively, similar to FIGS. 1 and 2, showing another modified form of the free wing portion at the upper end of the spring mat assembly and a modified attachment thereof to the seat back frame.
Figure 8A:
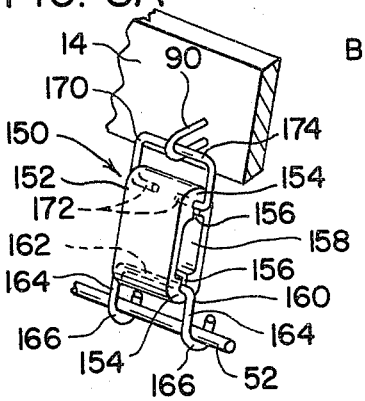
FIG. 8A is a fragmentary perspective view illustrating a modified form of resilient extensible support mounting for the spring mat assembly shown in FIGS. 7 and 8.
Figure 8:
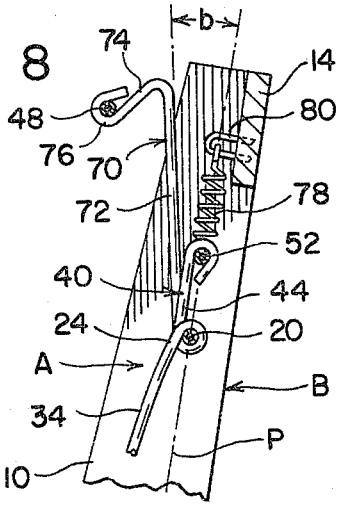

The modified form of free wing 70 shown in FIGS. 7 and 8 differs from the free wing 42 in FIGS. 1 and 2 in that the outwardly projecting stringer wire portions 72 forming the free wing 70 extend outwardly from the respective bolster wire 20 or 22 at a considerably smaller acute angle b of, for example, around 10° or so relative to the plane P of the two bolster wires 20, 22. In addition, the stringer wire portions 72 are formed with relatively short, transversely outward bent outer end portions 74 which are tightly hooked at their outer ends around the respective free wing border wire 48, as indicated at 76, so as to interconnect the stringer wire portions 72 at their outer ends into a unified wing structure. Also, the stringer wire portions 44 forming the fixed wing portion 40 at one or both ends of the assembly A are of considerably shorter length than they are in FIGS. 1 and 2, and the fixed wing portion or portions 40 are attached to the seat frame B by a plurality of resiliently extensible elements such as tension coil springs 78 which are hooked at one end around the respective fixed wing border wire 52 at spaced points therealong and are suitably secured at their outer ends, in a tensioned condition, to the respective end rail 14 or 16 of the seat frame B, as by means of staples 80, to resiliently mount the spring mat assembly A in place on the seat frame. The coil springs 78 are installed with the degree of pre-tensioning necessary to provide the desired degree of support for the spring mat assembly.

FIG. 8A illustrates a modified form of resiliently extensible mounting 150 which may be employed instead for each of the tension coil springs 78 shown in FIGS. 7 and 8, to resiliently support the spring mat assembly A on the seat frame B. Each mounting 150 comprises an extensible body member in the form of a relatively wide, thick-walled (e.g., around $\frac{1}{8}$ inch or so thick), elongated band 152 of yieldable rubber or other elastic material having thickened end wall portions 154 each provided with an inwardly opening key-hole slot 156 extending across the full width of the band 152 and opening into the slot-like interior space 158 of the band lengthwise thereof. The extensible body or band member 152 of each mounting 150 is attached at one end to the respective border wire 52 of the spring mat assembly A by a U-shaped wire hook member 160, the bight portion 162 of which is received and tightly gripped within the key-hole slot 156 at such one end of the band member. The two legs 164 of the hook member 160 are formed with open hook ends 166 which are caught or hooked around the respective fixed wing border wire 52 of the spring mat assembly A. The band member 152 is secured at its other end, in a taut or pre-tensioned condition, to the respective one of the end rails 14 or 16 of the seat frame B by a C-shaped wire connector member 170, the inturned end legs 172 of which are received and tightly gripped within the key-hole slot 156 at such other end of the band member 152. The connector members 170 of the plural mountings 150 for the assembly A are suitably secured at their bight portions 174 to the respective end rail 14 or 16 of the seat frame B, as by means of staples 90, for example, in a manner to hold the mountings 150 in a taut or longitudinally pre-tensioned condition so as to resiliently support the spring mat assembly A in place on the seat frame.

Figure 9:
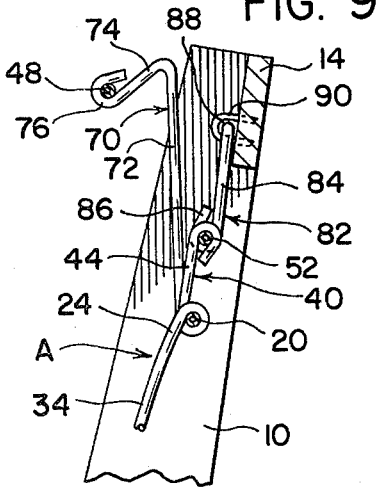
FIG. 9 is a fragmentary sectional view of the modified spring mat assembly shown in FIG. 8 with a modified form of attachment thereof to the seat back frame.
Figure 10:
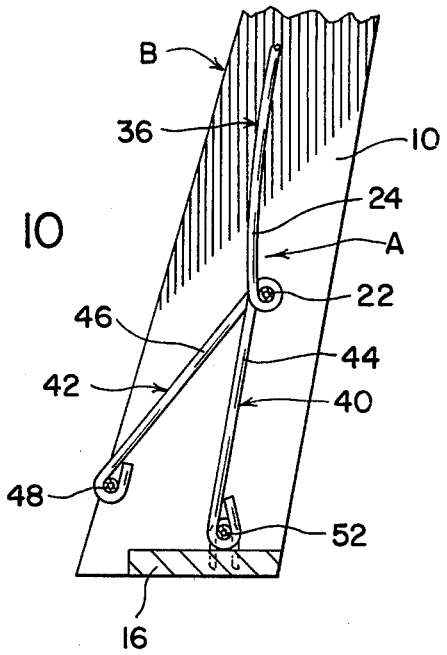
FIG. 10 is a sectional view similar to FIG. 2 of a modified form of the spring mat assembly having a free wing portion also at the lower end thereof.

FIG. 9 illustrates a modified form of support for the spring mat assembly A of FIGS. 7 and 8 on the seat frame B, wherein the supporting tension coil springs 78 of FIGS. 7 and 8 at one or both ends of the assembly are replaced by one or more U-shaped wire links 82 the legs of which are tightly hooked at their free ends around the respective fixed wing border wire 52 at spaced points therealong as indicated at 86. The links 82 are suitably secured at their bight portions 88 to the respective rails 14 or 16 of the seat frame B, as by means of staples 90, for example, to mount the spring mat assembly A in place on the seat frame.

In the modification shown in FIG. 11, a short longitudinal stiffener wire 92 similar to the bolster wires 20, 22 is clamped by one or more embracing ring clips 94 to each respective one, or to only one of the bolster wires from which a free wing portion 42 extends. The stiffener wire 92 extends parallel to and closely alongside the outboard side of the respective bolster wire, and between the stringer wire portions 44 and 46 forming the adjacent fixed and free wing portions 40 and 42 of the spring mat assembly A so as to be engaged by the free wing stringer wire portions 46 during flexure of the free wing 42. This engagement of the free wing stringer wire portions 46 with the added stiffener wire 92 then shortens the effective spring length and constrains the wind-up effect at 95 of these wire portions 46, thus stiffening the flexible free wing 42 to a considerable degree.

Figure 12:
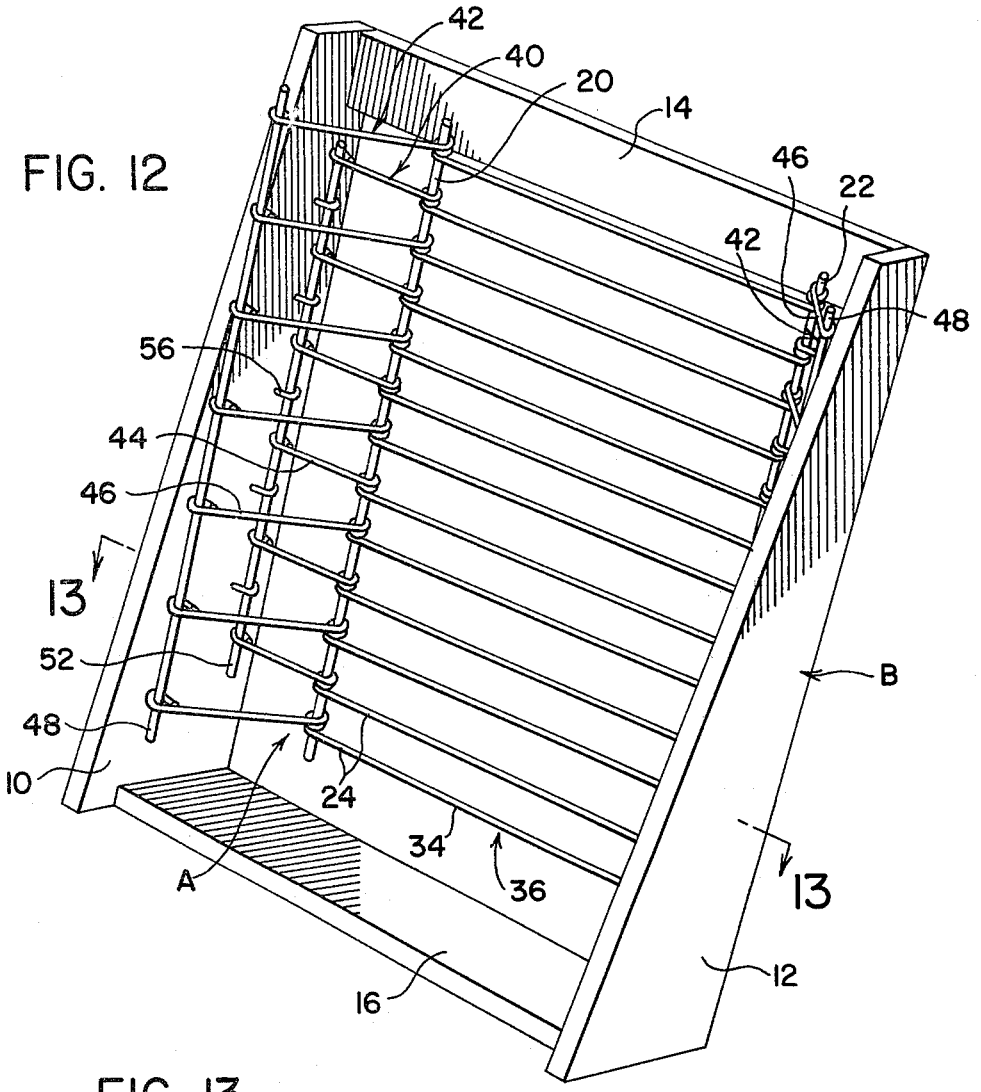
FIG. 12 is a perspective view similar to FIG. 1 of a modification of the invention wherein the spring mat assembly is mounted on the seat back frame with the stringer wires of the assembly extending transversely between the side rails of the frame.
Figure 13:
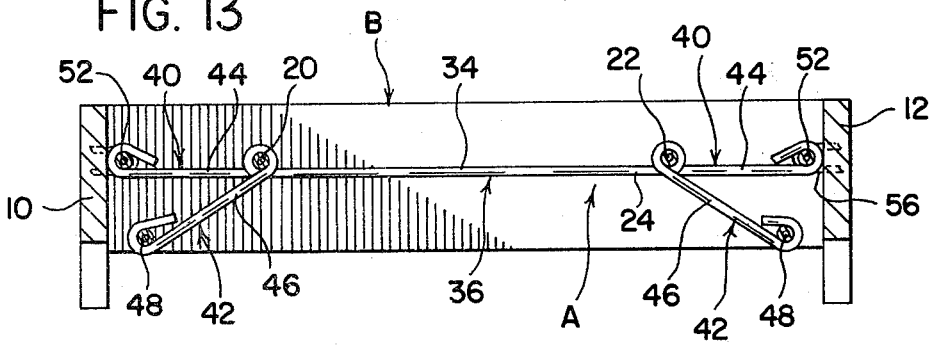
FIG. 13 is a sectional view taken on the line 13—13 of FIG. 12.

The modified seat construction illustrated in FIGS. 12 and 13 differs from that shown in FIGS. 1 and 2 mainly in that the spring mat assembly A thereof is shown mounted on the illustrated seat back frame B in a 90° rotated position relative thereto, with its bolster wires 20, 22 extending generally parallel to, and its stringer wires 24 extending transversely between, the side rails 10 and 12 of the frame B. In this mounted position of the assembly A in the frame B, the free wing portions 42 at each side of the spring mat assembly then serve as flexible support means for side "bolsters" on the finished upholstery-covered seat. As before, the spring mat assembly A is attached to frame B by staples 56 which, in this case, securely clamp the border wires 52 of the fixed wing portions 40 of the assembly to the side rails 10 and 12 of the seat frame.

Figure 14:
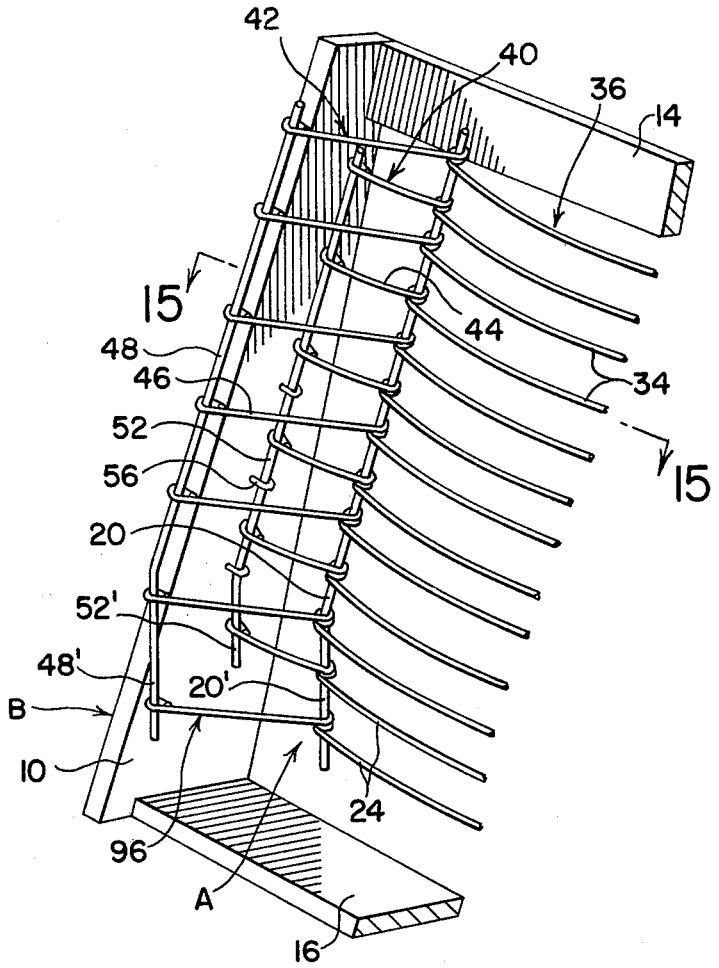
FIG. 14 is a fragmentary perspective view of a modification of the spring mat assembly shown in FIG. 12.
Figure 15:
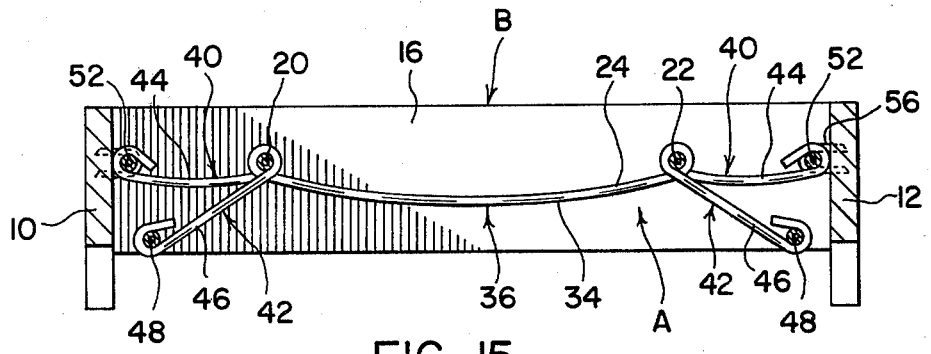
FIG. 15 is a sectional view on the line 15—15 of FIG. 14.

The modified seat construction of FIGS. 14 and 15 is essentially the same as that of FIGS. 12 and 13 except that the intermediate stringer wire portions 34 and the fixed wing stringer wire portions 44 are uniformly bowed forwardly or crowned laterally outward of the generally flat central portion 36 of the assembly A in a manner similar to that shown in FIG. 5, and further in that the free wing portions 42 of the assembly are formed with inwardly angled or toed-in lower end portions 96 to provide the seat back with side lumbar support capability. The toed-in lower portions of the free wings 42 are produced by bending the generally parallel extending bolster wires 20 or 22 and respective associated border wires 48 and 52 at each side of the assembly A in a direction inwardly thereof at corresponding points along their lengths adjacent their lowermost ends to form respective lower end length portions 20', 48' and 52' thereon angled laterally inward of the assembly at substantially corresponding obtuse angles to the major normal planes.

FIG. 16 illustrates one manner in which a spring mat assembly A similar to that shown in FIGS. 12 and 13 may be mounted on a seat back frame B to form the assembly with the crowned intermediate and fixed wing stringer wire portions 34 and 44, respectively, as shown in FIGS. 14 and 15. To this end, a spring mat assembly A as shown in FIGS. 12 and 13 having straight intermediate and fixed wing stringer wire portions 34 and 44 is initially fabricated with an overall length or span s across the outer extremities of its fixed wing portions 40 somewhat less than the distance d between the inside faces 10' and 12' of the side rails 10 and 12 of the seat back frame B on which the spring mat assembly is to be mounted, and with the wing portions 40 of the assembly extending at an obtuse angle to portion 36 thereof. The assembly is then distended by mounting it in such a manner between the side rails 10, 12 that border wires 52 of wing portions 40 fall in the same plane as bolster wires 20 and 22 to produce the outward bowing or crowning of the stringer wire portions 34 and 44 and distend the assembly to an overall length, across the outer extremities of the fixed wing portions 40, equal to the distance d between the frame side rails 10, 12 at assembly therebetween as by means of staples 56.

Figure 18:
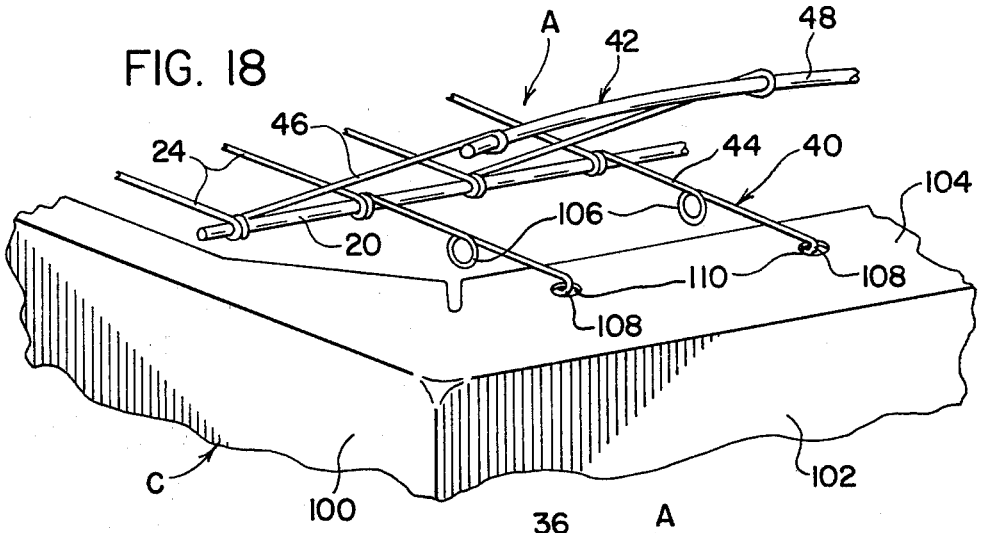
FIG. 18 is a fragmentary perspective view of the modified spring mat assembly and associated seat frame of FIG. 17 shown on an enlarged scale.

FIGS. 17 and 18 illustrate a modified form of spring mat assembly A according to the invention particularly suitable for use as the spring suspension for the seat base of a so-called bucket seat such as commonly employed at present in automobiles and having a frame C of sheet metal with front and rear rails 100 and side rails 102 provided with inturned top flanges 104. The spring assembly A in FIGS. 17 and 18 differs from the previous forms thereof described hereinabove mainly in that the stringer wire portions 44 forming the fixed wire portions 40 of the assembly are each formed medially of their length with a spring loop 106 disposed in a plane normal to the bolster wires 20, 22 to thereby impart a degree of spring flexibility to wire portions 44 and to the fixed wing portions 40. Also, the stringer wire portions 44 in FIGS. 17 and 18, instead of being interconnected at their outer end extremities by a border wire 52 as in the previously described forms of the invention, are simply formed at their outer end extremities with open hooks 108 for hooking into apertures 110 in the top flanges 104 of the seat frame side rails 102 to thereby mount the spring mat assembly A in place on the frame C. The stringer wires 46 of each free wing portion 42 in FIGS. 17 and 18 are of predetermined varying length diminishing toward each end thereof in order to produce an outwardly bowed or oblique configuration in the border wires 48 such as to generally conform to the design configuration of the plastic foam covering normally applied over the free wing portions.

Figure 19:
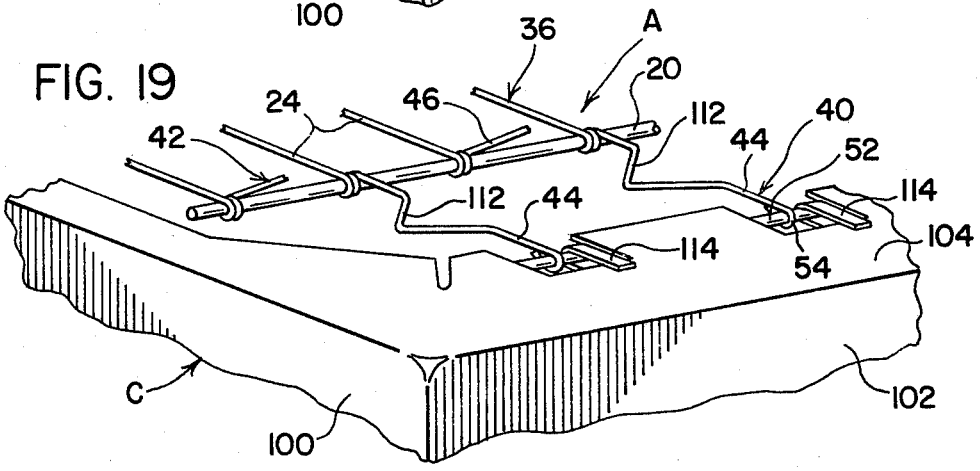
FIG. 19 is a fragmentary perspective view similar to FIG. 18 showing another modified form of spring mat assembly mounted on a seat base frame.

In the modification illustrated in FIG. 19, the stringer wire portions 44 of the fixed wing portions 40, instead of being each provided with a medial spring loop 106 as in FIGS. 17 and 18 to impart a degree of spring flexibility to the fixed wing portions, are each formed for such purpose with a medial Z-bend 112 disposed in a plane transverse to the bolster wires 20, 22. Also, in this modification, the stringer wire portions 44 of each fixed wing portion 40 are interconnected, as before, at their outer end extremities by a border wire 52 around which the wires 44 are tightly hooked, and the assembly A is mounted on the frame C by a plurality of fasteners such as U-shaped metal fastening clips 114 which are hooked around each respective one of the border wires 52 at spaced points therealong, as shown at 54, and which are suitably fastened to the flanges 104 of the frame C, as by spot welding, to hold the assembly A taut between the side rails 102 of the frame.

Figure 20:
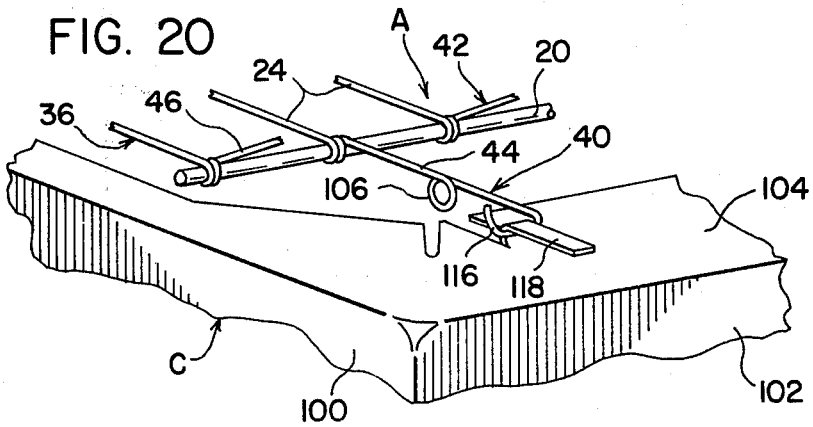
FIG. 20 is a fragmentary perspective view similar to and showing a modification of the spring mat assembly shown in FIG. 18; and, FIG. 21 is a fragmentary perspective view of a seat back frame provided with a well known prior art spring suspension.

The modified spring mat assembly A shown in FIG. 20 differs from that shown in FIGS. 17 and 18 only in the manner of attachment of the assembly to the seat base frame C, the stringer wire portions 44 of the fixed wing portions 40 in this case being formed at their outer end extremities with closed loops 116 which are disposed in a plane more or less parallel to the bolster wires 20, 22 and are secured to the top flanges 104 of the frame C by fasteners in the form of U-shaped metal fastening lugs 118 formed integral to the frame. The lugs 118 are pressed out of the top flanges 104 of the frame and receive the loop ends 116 of the stringer wire portions 44 to hold the assembly A taut between the side rails 102 of the frame.

Figure 21:
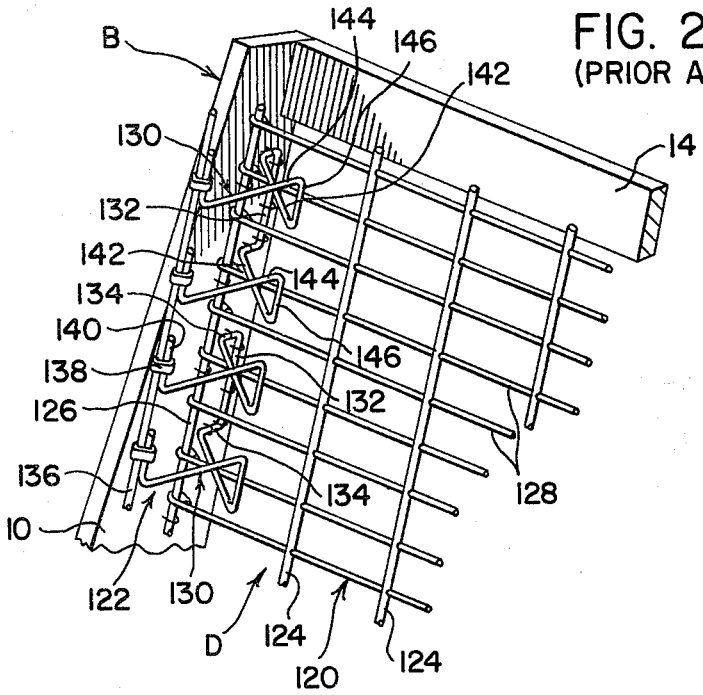
FIG. 21 (PRIOR ART)

FIG. 21 illustrates a well known prior art spring suspension D in common use at present for upholstered seats and comprised of a spring deck or mat portion 120, and free wing or so-called Z-spring edge portions 122 at the opposite sides of the mat portion 120 formed separately therefrom and mounted on the seat frame D independently of the mounting of the spring deck portion 120 thereon. The spring deck or mat portion 120 is comprised of a series of longitudinal, parallel bolster wires 124 and an outer border wire 126 at each side which are all interconnected by a plurality of relatively closely spaced parallel transverse stringer or cross wires 128 which are pierced through the bolster wires 122 and tightly hooked around the outer border wires 126. The spring deck portion 120 is suitably fastened in place on the seat frame B as by stapling the border wires 126 thereof to the inner faces of the opposite side rails 10 and 12 of the frame.

The free wing or Z-spring edge portions 122 of the spring suspension D are each comprised of a plurality (two in the particular case illustrated) of generally U-shaped Z-spring wire members 130 which are suitably attached at their bights or yoke portions 132, as by staples, to the inner faces of the respective side rails 10, 12 of the frame D, at points beneath or behind the spring deck 120 fastened thereon. The two legs or limbs 134 of each Z-spring wire member 130 extend upwardly or forwardly through the spaces between respective adjacent pairs of the stringer wires 128, and the top or outer free ends of all the legs 134 of the Z-spring wire members 130 comprising each Z-spring edge portion 122 are interconnected by a longitudinal border or edge frame wire 136 as by means of clips 138 which clamp right angle bent end portions 140 of the legs 134 to the border wire 136 in a position extending alongside the same. The two legs 134 of each Z-spring wire member 130 are formed with parallel forwardly and inwardly angled base end portions 142 and parallel forwardly and outwardly angled outer end portions 144 which are joined by a medial bridge portion 146 which extends generally parallel to the plane of the spring deck portion 120 and is located outwardly thereof. The angled leg portions 142, 144 of the Z-spring wire members 130 impart spring flexibility thereto, and to the Z-spring edge portions 122 of the spring suspension D so as to yield under loading conditions.

It will be evident that the prior art spring suspension D of FIG. 21 is composed of several independent members, namely the spring deck portion 120 and the several Z-spring wire members 130 which must be manufactured separately, and the Z-spring edge portions 122 then added to the spring deck portion by threading the legs 134 of the Z-spring wire members 130 between the appropriate stringer wires 128 of the spring deck and then interconnecting their outer bent end portions 140 by clamping them to the respective border wire 136 by means of the clips 138. Such an assembly of all these component parts of the spring suspension D thus constitutes a relatively expensive fabrication procedure.

By way of comparison, the spring mat assembly A comprising the present invention can be manufactured as a single, fully integrated structure by completely automatic machine manufacturing operations. For example, the stringer wires 24 are first wrapped tightly around the bolster wires 20, 22 on an automatic machine, with the outwardly projecting stringer wire portions 44 for each fixed wing portion 40 extending straight out from the respective bolster wire 20 or 22 and the outwardly projecting stringer wire portions 46 for each free wing portion 42 extending outward from the respective bolster wire 20 or 22 at an obtuse angle to the intermediate portion 34 of the stringer wire, to form a sub-assembly. The outwardly projecting wire portions 44 and 46 of the sub-assembly thus formed are then tightly hooked, by automatic machine operations, around respective border wires 48 and 52 for each fixed and free wing portion 40 and 52, while these border wires are fixedly held in their respective positions relative to one another and to the associated bolster wire 20 or 22.

Having thus described the invention, the following is claimed:

1. An integrated spring mat assembly for a generally rectangular rigid seat frame having end rails and side rails, said spring mat assembly comprising a relatively widely spaced pair of longitudinal bolster wires, a plurality of relatively closely spaced transverse spring steel stringer wires having intermediate wire portions extending between and connected to said bolster wires to form therewith a generally flat central support portion of said assembly, said stringer wires having extended portions projecting outwardly beyond each of said bolster wires to form edge wing portions on said assembly including a fixed wing portion on each end of said assembly and a free wing portion on at least one end of said assembly, said free wing portion forming together with the adjacent one of said fixed wing portions a split-wing edge on said assembly, said free wing portion being comprised of the said outwardly projecting portions of selective ones of said stringer wires extending side-by-side from the respective one of said bolster wires to the same one side of and in spaced relation to the adjacent one of said fixed wing portions, a longitudinal border wire interconnecting the free outer ends of the said selective stringer wires forming the said free wing portion of said assembly, and the free outer ends of said stringer wires forming the said fixed wing portions of said assembly being provided with fastening means for attaching the assembly to opposed rails of the said seat frame in a position therebetween.

2. A spring mat assembly as defined in claim 1 wherein the said outwardly projecting portions of the said selective ones of said stringer wires forming the said free wing portion of said assembly extend angularly from the said intermediate wire portions thereof at an obtuse angle.

3. A spring mat assembly as defined in claim 1 wherein each of said edge wing portions includes a said fixed wing portion and a said free wing portion.

4. A spring mat assembly as defined in claim 1 wherein the said outwardly projecting portions of alternate ones of said stringer wires respectively form the said fixed wing and free wing portions of the said split-wing edge of said assembly.

5. A spring mat assembly as defined in claim 2 wherein each of said edge wing portions includes a said fixed wing portion and a said free wing portion.

6. A spring mat assembly as defined in claim 3 wherein the outwardly projecting portions of alternate ones of said stringer wires respectively form the said fixed wing portion and free wing portion of each of said edge wing portions.

7. A spring mat assembly as defined in claim 1 wherein the said stringer wires are wrapped tightly around the said bolster wires.

8. A spring mat assembly as defined in claim 7 wherein the said bolster wires have a paper wrapping therearound over which the said stringer wires are wrapped.

9. A spring mat assembly as specified in claim 7 wherein the said bolster wires have a plastic coating thereon.

10. A spring mat assembly as defined in claim 2 wherein the said stringer wires are wrapped tightly around the said bolster wires.

11. A spring mat assembly as defined in claim 2 wherein the said stringer wires pierce the said bolster wires.

12. A spring mat assembly as defined in claim 3 wherein the said stringer wires are wrapped tightly around the said bolster wires.

13. A spring mat assembly as defined in claim 4 wherein the stringer wires are wrapped tightly around the said bolster wires.

14. A spring mat assembly as defined in claim 5 wherein the said stringer wires are wrapped tightly around the said bolster wires.

15. A spring mat assembly as defined in claim 1 wherein the said outwardly projecting portions of each of said stringer wires forming each respective one of said fixed wing portions are formed with open hooks at their outer ends.

16. A spring mat assembly as defined in claim 1 wherein the outer ends of the said outwardly projecting portions of said stringer wires forming each respective one of said fixed wing portions are interconnected by a separate additional longitudinal border wire forming said fastening means.

17. A spring mat assembly as defined in claim 16 wherein all the said stringer wires are wrapped tightly around the said bolster wires, and the outer ends of all those stringer wires forming each respective one of said fixed wing portions are hooked around their respective interconnecting border wire.

18. A spring mat assembly as defined in claim 17 wherein the said bolster wires and border wires all have a paper wrapping therearound over which the said stringer wires are respectively wrapped and hooked.

19. A spring mat assembly as defined in claim 17 wherein the said bolster wires and border wires all have a plastic coating thereon.

20. A spring mat assembly as defined in claim 1 wherein the said intermediate wire portions of said stringer wires extending between the said bolster wires are uniformly bowed laterally to the same side of said assembly on which the said free wing portion thereof is disposed relative to the said adjacent fixed wing portion.

21. A spring mat assembly as defined in claim 1 having a single split-wing edge at one end only thereof and wherein the said outwardly projecting portions of the said stringer wires forming the said fixed wing portion at the other end of said assembly are uniformly bowed laterally to the same side of said assembly on which the said free wing portion thereof is disposed relative to the said adjacent fixed wing portion.

22. A spring mat assembly as defined in claim 1 wherein each of said edge wing portions include a said fixed wing portion and a said free wing portion, and the said intermediate wire portions of said stringer wires and the said outwardly projecting portions of the stringer wires forming the said fixed wing portions at both ends of said assembly are respectively uniformly bowed laterally to the same side of said assembly on which the said free wing portions thereof are disposed relative to the said adjacent fixed wing portions.

23. A spring mat assembly as defined in claim 1 wherein a longitudinal stiffener wire extends parallel to and closely alongside the outboard side of the said one of said bolster wires from which the said free wing portion extends, said stiffener wire extending between the outwardly projecting portions of said stringer wires respectively forming the said free wing portion and the adjacent said fixed wing portion, said stiffener wire being securely clamped to said one bolster wire in spaced relation thereto by clip means whereby to engage the stringer wires of and effectively stiffen the said free wing portion during flexure.

24. A spring mat assembly as defined in claim 1 wherein the outermost end portions of the said outwardly projecting portions of said selective ones of stringer wires forming said free wing portion are offset from and extend in generally parallel spaced relation to the said outwardly projecting portions of the other ones of said stringer wires forming the said adjacent one of said fixed wing portions.

25. A spring mat assembly as defined in claim 1 wherein the outer ends of the said stringer wires forming at least one of said fixed wing portions on said assembly are interconnected by an additional longitudinal border wire, and a plurality of resiliently extensible elements are attached at one end to said additional border wire at spaced points therealong for attachment in a tensioned condition at their other ends to said seat frame to mount the assembly in place thereon.

26. A spring mat assembly as defined in claim 25 wherein the said fixed wing portion to which the said resiliently extensible elements are attached comprises in part the said split-wing edge of said assembly and is of appreciably shorter longitudinal extent than the said free wing portion of said split-wing edge.

27. A spring mat assembly as defined in claim 2 wherein the outermost end portions of said angularly extending outwardly projecting portions of said stringer wires forming the said free wing portion of said split-wing edge are bent transversely outward relative thereto away from said spring mat assembly.

28. A spring mat assembly as defined in claim 1 wherein the outer ends of the said stringer wires forming at least one of said fixed wing portions on said assembly are interconnected by an additional longitudinal border wire, and a plurality of wire links are attached at one end to said additional border wire at spaced points therealong for attachment at their other ends to said seat frame to mount the assembly in place thereon.

29. A spring mat assembly as defined in claim 1 wherein the said outwardly projecting portions of each of said stringer wires forming the said fixed wing portions of said assembly are formed intermediate their ends with offset spring bends therein yieldable transversely of said bolster wires.

30. A spring mat assembly as defined in claim 29 wherein the said offset spring bends in said fixed wing portion stringer wires are in the form of spring loops therein.

31. A spring mat assembly as defined in claim 29 wherein the said offset spring bends in said fixed wing portion stringer wires are in the form of Z-shaped bends therein.

32. A spring mat assembly as defined in claim 29 wherein the said outwardly projecting portions of each of said stringer wires forming the said fixed wing portions of said assembly are formed with open hooks at their outer ends.

33. A spring mat assembly as defined in claim 29 wherein the outer ends of the said outwardly projecting portions of said stringer wires forming each respective one of said fixed wing portions are interconnected by a separate longitudinal border wire forming said fastening means.

34. A spring mat assembly as defined in claim 29 wherein each of said edge wing portions includes a said fixed wing portion and a said free wing portion and the said outwardly projecting portions of the said selective ones of said stringer wires forming the said free wing portions of said assembly extend angularly from the said intermediate wire portions thereof at an obtuse angle, the said stringer wire portions of said free wing portions being formed of varying length diminishing toward each end of said free wing portions to thereby locate the respective border wires in predetermined obliquely oriented outwardly bowed positions.

35. A spring mat assembly as defined in claim 34 wherein the said outwardly projecting portions of each of said stringer wires forming the said fixed wing portions of said assembly are formed intermediate their ends with offset spring bends therein yieldable transversely of said bolster wires.

36. A spring mat assembly as defined in claim 3 for mounting on a seat back frame, having top and bottom rails and side rails, in a position with the said stringer wires extending transversely between the said side rails of said frame, wherein the outer ends of the said outwardly projecting portions of said stringer wires forming each respective one of said fixed wing portions are interconnected by a separate additional longitudinal border wire forming said fastening means, and wherein the said bolster and border wires and said additional bolster wire, at each side edge of said assembly, have corresponding lower end length portions thereof angled laterally inward of the assembly at substantially corresponding obtuse angles.

37. A spring mat assembly as defined in claim 36 wherein the said intermediate wire portions of said stringer wires and the said outwardly projecting portions of the stringer wires forming the said fixed wing portions at both side edges of said assembly are respectively uniformly bowed laterally to the same side of said assembly on which the said free wing portions thereof are disposed relative to the said adjacent fixed wing portions.

38. The method of fabricating a spring mat assembly for a seat frame comprising the steps of securing a plurality of stringer wires at corresponding points intermediate their lengths to a longitudinal bolster wire in spaced apart relation extending transversely thereof and with outer end wire portions projecting outwardly therebeyond, and then securing the outermost ends of the said outwardly projecting end wire portions of selective ones of said stringer wires to one of a pair of longitudinal border wires spaced laterally outward from said bolster wire and transversely of said stringer wires, and securing the outermost ends of the said outwardly projecting end wire portions of the others of said stringer wires to the other one of said pair of border wires.

39. The method as defined in claim 38 wherein the outermost ends of the said outwardly projecting end wire portions of successive ones of said stringer wires are secured to alternate ones of said pair of border wires.

40. The method as defined in claim 38 wherein the step of securing said stringer wires to said bolster wire comprises wrapping said stringer wires tightly around said bolster wire.

41. The method as defined in claim 40 wherein the step of securing the outer ends of said stringer wires to one or the other of said border wires comprises tightly hooking the said stringer wires around the respective border wire.

* * * * *